US011191329B2

(12) United States Patent
Zhu

(10) Patent No.: US 11,191,329 B2
(45) Date of Patent: Dec. 7, 2021

(54) ARM-HELD UMBRELLA

(71) Applicant: Zhanxin Zhu, Beijing (CN)

(72) Inventor: Zhanxin Zhu, Beijing (CN)

( * ) Notice: Subject to any disclaimer, the term of this patent is extended or adjusted under 35 U.S.C. 154(b) by 0 days.

(21) Appl. No.: 17/033,944

(22) Filed: Sep. 28, 2020

(65) Prior Publication Data

US 2021/0022464 A1 Jan. 28, 2021

Related U.S. Application Data

(63) Continuation of application No. PCT/CN2019/000084, filed on Apr. 30, 2019.

(30) Foreign Application Priority Data

May 16, 2018 (CN) ..... 201810465178.1

(51) Int. Cl.
*A45B 11/02* (2006.01)
*A45B 25/02* (2006.01)
*A45B 25/00* (2006.01)

(52) U.S. Cl.
CPC ..... *A45B 11/02* (2013.01); *A45B 25/02* (2013.01); *A45B 2025/003* (2013.01)

(58) Field of Classification Search
CPC ..... A45B 11/02
See application file for complete search history.

(56) References Cited

U.S. PATENT DOCUMENTS

| | | | | |
|---|---|---|---|---|
| 4,188,965 | A * | 2/1980 | Morman | A45B 11/02 135/15.1 |
| 4,871,141 | A * | 10/1989 | Chen | F16M 13/022 248/534 |
| 4,967,943 | A * | 11/1990 | Massey | A45B 11/02 224/189 |
| 5,365,966 | A | 11/1994 | McLaren | |
| 6,637,447 | B2 * | 10/2003 | McMullin | A45B 11/00 135/16 |
| 7,040,593 | B1 | 5/2006 | Weatherall | |
| 9,241,549 | B2 | 1/2016 | Ma | |
| 2021/0169186 | A1 * | 6/2021 | Ahmed | A45B 11/02 |

FOREIGN PATENT DOCUMENTS

| | | |
|---|---|---|
| CN | 202496554 U | 10/2012 |
| CN | 204336059 U | 5/2015 |
| CN | 204832307 U | 12/2015 |

(Continued)

*Primary Examiner* — Noah Chandler Hawk
(74) *Attorney, Agent, or Firm* — True Shepherd LLC; Andrew C. Cheng

(57) ABSTRACT

An arm-held umbrella includes an umbrella and an arm connector. One end of a supporting rod of the umbrella is mechanically connected with the arm connector so that the umbrella can rotate at a certain included angle relative to the length direction of the arm; the arm connector can be wrapped and fixed on the arm, and can also be used as a handle for holding umbrella by hand. Exactly, the umbrella attachable to the arm is "a multipurpose umbrella", which can not only be attached to arm but also be held by hand. Especially, holding the umbrella under the state of bent arm meets various demands of people, for example, playing a mobile phone with both hands, cycling or taking photos while holding the umbrella.

6 Claims, 4 Drawing Sheets

(56) References Cited

FOREIGN PATENT DOCUMENTS

| | | | | | |
|---|---|---|---|---|---|
| CN | 204930601 | U | | 1/2016 | |
| CN | 106998380 | A | | 8/2017 | |
| CN | 206675128 | U | | 11/2017 | |
| CN | 107411266 | A | | 12/2017 | |
| CN | 108669729 | A | | 10/2018 | |
| DE | 2734663 | A1 | * | 2/1979 | ..... A45B 11/02 |
| FR | 2221098 | A1 | * | 10/1974 | ..... A45B 11/02 |
| JP | 3182542 | U | | 4/2013 | |
| WO | 2007016877 | A1 | | 2/2007 | |

* cited by examiner

ARM-HELD UMBRELLA

CROSS-REFERENCE TO RELATED APPLICATIONS

This application is a continuation of International Patent Application No. PCT/CN2019/000084 with a filing date of Apr. 30, 2019, designating the United States, now pending, and further claims priority to Chinese Patent Application No. 201810465178.1 with a filing date of May 16, 2018. The content of the aforementioned applications, including any intervening amendments thereto, are incorporated herein by reference.

TECHNICAL FIELD

The disclosure relates to an arm-held umbrella, belonging to the field of daily necessities.

BACKGROUND OF THE PRESENT INVENTION

The way of holding umbrella by hand has lasted for thousands of years. With the development and progress of society, the way of holding umbrella cannot meet the needs of modern people's life. How to change it has become a new topic for us.

Properly speaking, the problem that people encounter in the modern life of how to realize interexchange between holding umbrella by arm and holding umbrella by hand on the same umbrella, can be solved by providing a multipurpose umbrella. The "arm-held umbrella" not only relieves people's fatigue caused by holding the umbrella with a single hand when they go out in the hot sunny, rainy and snowy weathers, but also meets the needs of liberating two hands while holding the umbrella under the state of the bent arm, for example playing mobile phones, taking photos, cycling, holding materials and sweeping by sanitation workers, in particular, a worry that the attraction is dispersed when the old people hold umbrella with one hand and lean on crutches with the other hand so as not to benefit going out is solved. When the umbrella holding angle and direction on the arm are changed to simulate holding the umbrella with the hand, it is the same as changing the umbrella holding angle and direction when encountering sun, rain and snow, that is to say, an included angle between the umbrella (supporting rod) after rotating relative to the length direction of the arm and the arm is formed, the arm connector can horizontally rotate around the arm, combination of the umbrella and the arm connector reaches the same effect as that of holding umbrella by hand. The significant difference between holding the umbrella in a form of a straight arm and holding the umbrella in a form of a bent arm is that when the umbrella is held at the state of the straight arm, the umbrella is almost basically parallel to the arm; when the umbrella is held at the state of the bent arm, there is an included angle between the umbrella (supporting rod) and the arm, especially, holding the umbrella at the state of the bent arm has the most significant effect when photos are taken in sunlight day or rainy and snowy days, which can not only hold the camera with two hands to prevent the camera from shaking, but also the possibility that the camera is wetted is reduced since the forward movement of the umbrella on the center position of the arm increases the effective shielding surface of the umbrella. In addition, when the arm connector is in a closed state, and rotates to be parallel to the umbrella (supporting rod), it can also be used as a handle for holding the umbrella. All of these are due to a fact that the umbrella rotates at a certain included angle relative to the length direction of the arm (the central supporting rod of the umbrella is referred to as the supporting rod and the circular arc-shaped clamping element is referred to as the are clamping element).

SUMMARY OF PRESENT INVENTION

Aiming at the above use requirements in the prior art, the present disclosure provides an arm-held umbrella, which is capable of changing the way for holding umbrella from holding by hand to independently holding by arm. The arm-held umbrella comprises an umbrella and an arm connector. The umbrella in the technical solution is an umbrella used in people's daily life, and the difference is that one end of a supporting rod of the umbrella is mechanically connected with the arm connector. The arm connector is connected with the umbrella and further connected and fixed on the arm through arc clamping elements.

Further, the arm connector comprises a supporting frame which comprises a solid cylinder and a hollow cylinder. The solid cylinder is to strength the contact between the umbrella and the arm so that the umbrella is more firmly connected to the arm, functions as a spindle and used for connecting with the arc clamping elements. When the round holes on the arc clamping elements are respectively, symmetrically, successively and rotatably sleeved at two sides of the solid cylinder equipped with the spring, the sequence at each side is as follows: arc clamping element-spring-arc clamping element-plug, the plug aims to prevent the arc clamping elements from falling off from the solid cylinder. When the umbrella is held, if an external force is applied to an upper part of the arc clamping element to overcome the elastic force of the spring and is rotated through the solid cylinder, a lower part of the are clamping element is open and wrapped on the arm, then the solid cylinder is fixed on the arm through a fixing hole on the are clamping element in a soft or hard or soft-hard combined connection manner, that is to say, the connection and fixation of the arm connector and the arm is completed.

The hollow cylinder is rotatably connected to an upper part of the solid cylinder and the hollow cylinder is used for mechanically connecting with one end of the supporting rod so that the umbrella carried by the supporting rod can rotate an a certain included angle relative to the length direction of the arm, and the whole arm connector can transversely rotates on the arm. The combination of the umbrella and the arm connector allows the umbrella to simulate the state of holding umbrella by hand, the effect of keeping out wind and rain is the same through change in the umbrella holding angle and direction. Especially, the arms are at the bending state when playing the mobile phones with two hands, taking photos, cycling and taking materials, at this moment, holding the umbrella benefits from a fact that the umbrella can rotates at a certain included angle relative to the length direction of the arm, which releases two hands and meets various demands of the user, improves the effective shielding surface of the umbrella so that people acquire a good assistant when going out in sunny day or snowy and rainy days. Improving the effective shielding surface of the umbrella especially taking photos in sunny day or snowy and rainy days has the most obvious reflection, in this way, the umbrella is held with two hands to prevent the shaking of the cream, and the possibility that the camera is wetted is reduced since the forward movement of the umbrella on the center position of the arm increases the effective shielding surface of the umbrella. After raining, if the umbrella is angled with the arm to a certain extent to be carried on the arm, rainwater flows toward the ground along the tips of the umbrella but not wets clothes. At ordinary times, the arc clamping elements on the arm connector are in a closed state under the action of the spring, the shape of the arm connector becomes smaller and slight larger than the handle of the ordinary handle, however, it has stronger hand holding feeling and can serve as the handle.

1—umbrella
2—arm connector
3—solid cylinder
4—hollow cylinder
5—round hole
6—arc clamping element
7—spring
8—fixing hole
9—supporting rod
10—supporting frame

DETAILED DESCRIPTION OF PREFERRED EMBODIMENTS

The technical solution in the embodiment of the disclosure will be clearly and completely described in combination with accompanying drawings in the embodiment of the disclosure in the following. Obviously, the described embodiment is only a part of the embodiments of the disclosure but not all the embodiments. Based on the embodiment of the disclosure, all the other embodiments obtained by one of ordinary skill in the art without creative efforts belong to the protection scope of the disclosure.

Figure 1:
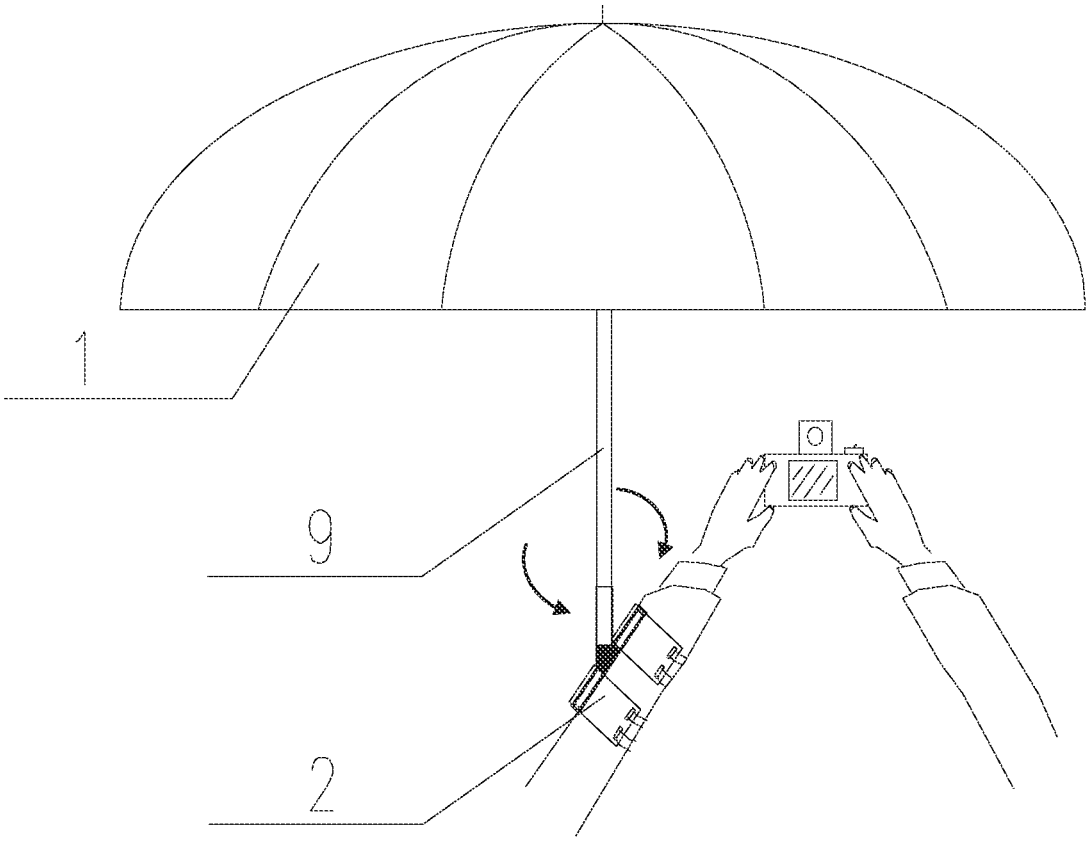
FIG. 1 is a diagram of an arm-held umbrella according to an embodiment of the disclosure.

FIG. 1 is an effect picture showing an arm-held umbrella, in which one end of the supporting rod 9 of the umbrella 1 is mechanically connected with the arm connector 2, so that the umbrella can rotate at an included angle relative to the length direction of the arm.

Figure 2:
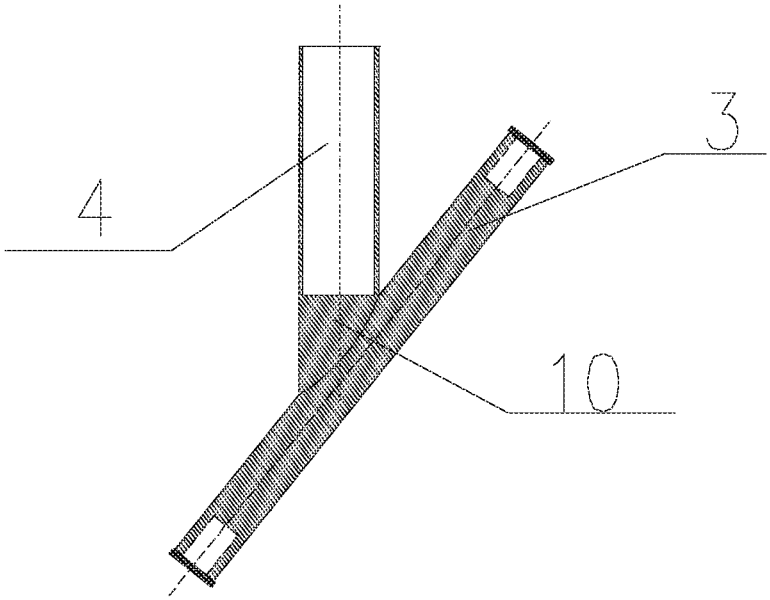
FIG. 2 is a structural diagram of a supporting frame.

FIG. 2 is an effect picture of a supporting frame. The supporting frame 10 is one of the components of the arm connector 2 in FIG. 1, in which the lower end of the supporting frame 10 is provided with the solid cylinder 3 whose two ends are provided with holes and plugs, and the upper part of the solid cylinder 3 is provided with a rotatably connected hollow cylinder 4, the two sides of the solid cylinder 3 are used for connecting and fixing the arc clamping elements 6, and the hollow cylinder 4 is used for mechanical connection with one end of the supporting rod 9.

Figure 3:
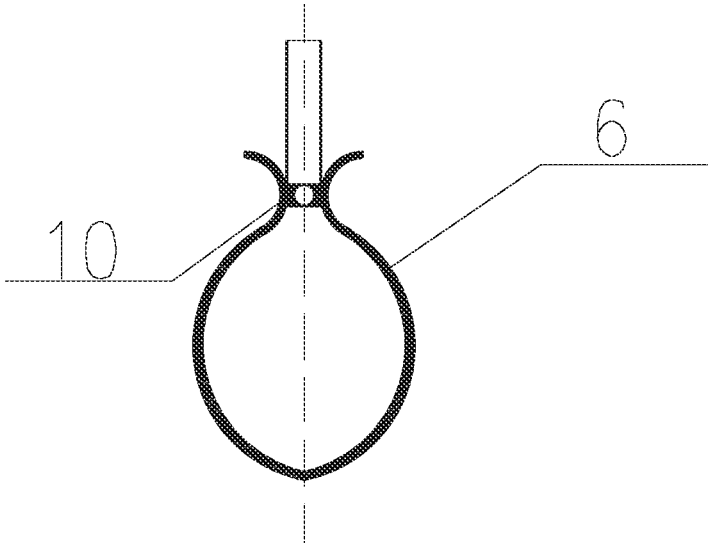
FIG. 3 is a structural diagram showing the supporting frame connected and fixed with arc clamping elements in a closed state.

FIG. 3 is an effect picture of the supporting frame 10 connected and fixed with the arc clamping elements 6 in a closed state. When the arc clamping elements 6 are rotatebly sleeved at the two ends of the solid cylinder 3 in pairs (as shown in FIGS. 1 and 2), the solid cylinder 3 can also act as a rotating shaft. When the upper part of the arc clamping elements 6 overcomes the elastic force of the spring under the action of an external force and hence rotates, the lower part of the arc clamping elements 6 are open and then wrapped on the arm. When one end of the supporting rod 9 is mechanically connected with the hollow cylinder 4, the technical solution that the arm-held umbrella is jointly completed.

Figure 4:
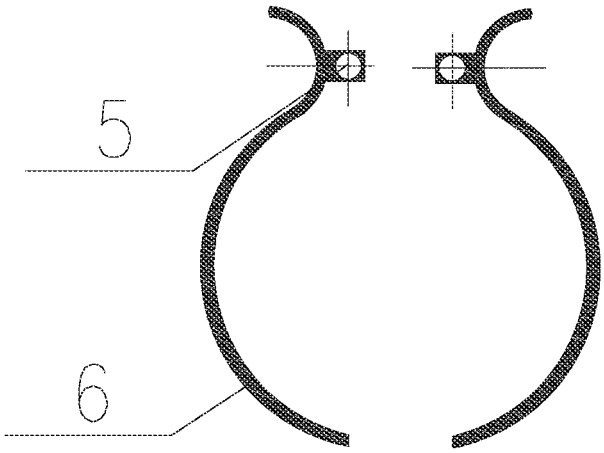
FIG. 4 is a side sectional view of arc clamping elements.

FIG. 4 shows a side sectional view of arc clamping elements 6. There are four pieces of arc clamping elements 6, each two arc clamping elements are opposite. The upper part of each arc clamping element is provided with a round hole 5 to be symmetrically, successively and rotatebly connected and fixed with the two sides of the solid cylinder 3 in pairs (as shown in FIG. 2 and FIG. 3).

Figure 5:
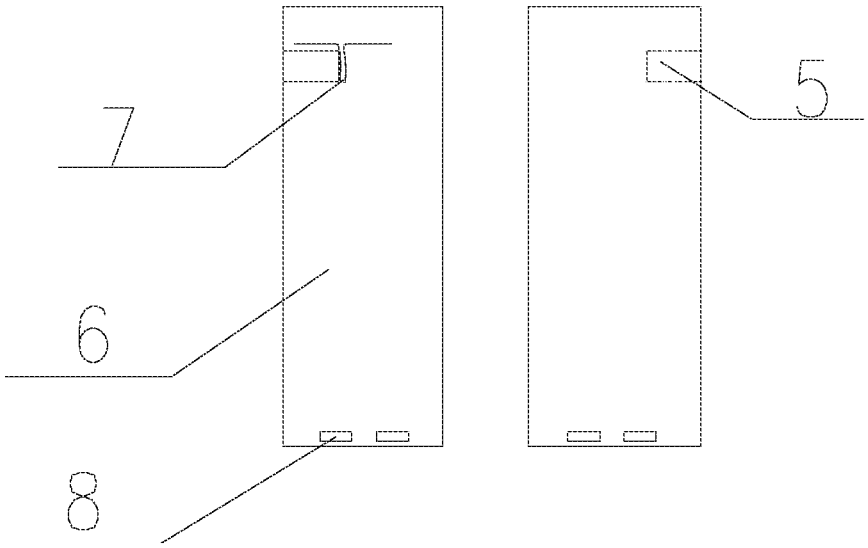
FIG. 5 is a structural diagram of a front view of an arc clamping elements.

FIG. 5 is a front view of arc clamping elements 6. The transverse length of the round hole 5 is about half of the transverse length of the arc clamping element 6. In order to allow the arc clamping elements 6 to be relatively and symmetrically connected to the two sides of the solid cylinder 3, springs 7 are each installed in the middles of two sides of the solid cylinder 3 so that the opposite are clamping elements 6 are closed together (as shown in FIG. 3). The arc clamping elements 6 are sleeved at the two sides of the solid cylinder 3 (as shown in FIG. 1), and the sequence at each side is as follows: arc clamping element 6—spring 7—arc clamping element 6—plug. The bottom of each arc clamping element 6 is provided with a fixing hole 8. When the arc clamping elements 6 are wrapped on the arm, the arm connector 2 is connected and fixed on the arm through the fixing hole 8 through a soft or hard or a soft hard combined connection manner (as shown in FIG. 1).

As shown in FIG. 1, the arm connector 2 is close to the arc clamping elements 6 at one side of the hand. Because the arm gradually becomes thicker, its size is slightly smaller than that of the arc clamping element 6 at the other side, which meets the requirements of tight fixation and conforms to the requirements of ergonomics.

As shown in FIG. 1, when the umbrella 1 is folded, the arm is downward, and the arm connector 2 fixed on the arm makes the umbrella tip point to the outside so that the rain can not be splashed on the body. Importantly, the released two hands can do more at this moment.

As shown in FIG. 1 and FIG. 3, when the arc clamping element 6 is in the closed state, its shape becomes smaller in size and the arc clamping element 6 can be used as a handle for holding the umbrella by hand.

In the disclosed embodiment, some changes can be made, such as an integrally formed arm connector and a connector with a changeable angle in the supporting frame. The changes do not depart from the concept that the umbrella related in the disclosure can be fixed on the arm and can rotate relative to the arm. Therefore, the contents described in the claims cover all the scopes of the disclosure and any modification within this scope.

As shown in FIG. 1, the arm connector 2 is mechanically connected with one end of the supporting rod 9 of the umbrella 1, so that the umbrella can rotate at a certain angle relative to the length direction of the arm, and the arm connector 2 is fixed on the arm through the are clamping elements 6, so as to realize the purpose of releasing two hands to hold the umbrella.

I claim:

1. An arm-held umbrella for changing umbrella holding manner in daily life from holding by a hand to holding by an arm, comprising an umbrella (1) and an arm connector (2), wherein one end of a supporting rod (9) of the umbrella (1) is mechanically connected with the arm connector (2) ensuring that the supporting rod (9) of the umbrella (1) is rotatable at a certain included angle relative to a length direction of the arm, and the arm connector (2) is wrapped around and fixed to the arm;

the arm connector (2) comprises a supporting frame (10), and arc clamping elements (6); the supporting frame (10) comprises a solid cylinder (3) and a hollow cylinder (4), the solid cylinder (3) is used for connecting and fixing the arc clamping elements (6), and the hollow cylinder (4) rotatably connected with the solid cylinder (3) is mechanically connected with one end of the supporting rod (9) of the umbrella (1) so that the umbrella (1) is rotatable relative to the arm.

2. The arm-held umbrella according to claim 1, wherein each arc clamping element (6) is provided with a round hole (5), two arc clamping elements are symmetrically sleeved at two sides of the solid cylinder (3) through the round holes (5), two sides of the solid cylinder (3) are each equipped with a spring (7) whose function is to allow the arc clamping elements (6) connected to the solid cylinder (3) to be in a closed state, and a connection sequence of the arc clamping elements (6) in each end of the solid cylinder (3) is as follows: arc clamping element (6)-spring (7)-arc clamping element (6).

3. The arm-held umbrella according to claim 1, wherein the arc clamping elements (6) are open under an external force applied to an upper part of the arc clamping elements to overcome an elastic force of the spring, and the opened arc clamping elements are connected and fixed on the arm.

4. The arm-held umbrella according to claim 1, wherein a horizontal length of the round hole (5) on each arc clamping element (6) is half of a horizontal length of the arc clamping element (6) so that the arc clamping elements (6) facing each other are symmetrically connected to the two ends of the solid cylinder (3), a hole is provided at two sides of the solid cylinder (3) in order to prevent the arc clamping elements (6) from falling off from the solid cylinder (3).

5. The arm-held umbrella according to claim 1, wherein the arm connector (2) is fixed on the arm through a fixing hole (8) on the arc clamping elements (6).

6. The arm-held umbrella according to claim 1, wherein the arm connector (2) serves as a handle for holding the umbrella by a hand when being not wrapped and fixed on the arm.

* * * * *